US006599206B1

(12) United States Patent
Forrest, Sr. et al.

(10) Patent No.: US 6,599,206 B1
(45) Date of Patent: Jul. 29, 2003

(54) TRIPLE REACTOR LINEMAN TRAINER

(76) Inventors: Charles P. Forrest, Sr., 33923 Hwy. 59, Loxley, AL (US) 36551; Charles P. Forrest, Jr., 33923 Hwy. 59, Loxley, AL (US) 36551

( * ) Notice: Subject to any disclaimer, the term of this patent is extended or adjusted under 35 U.S.C. 154(b) by 0 days.

(21) Appl. No.: 09/669,696

(22) Filed: Sep. 26, 2000

(51) Int. Cl.[7] ..... A63B 69/34; A63B 69/00
(52) U.S. Cl. ..... 473/441; 473/438
(58) Field of Search ..... 473/441, 442, 473/443, 444, 445

(56) References Cited

U.S. PATENT DOCUMENTS

| | | | | | |
|---|---|---|---|---|---|
| 2,696,383 | A | * | 12/1954 | Noftsinger | 472/14 |
| 2,967,709 | A | * | 1/1961 | Stahley | 473/441 |
| 3,062,547 | A | * | 11/1962 | Kopp | 434/251 |
| 3,578,324 | A | * | 5/1971 | Alvey et al. | 473/441 |
| 3,674,265 | A | * | 7/1972 | Sheets et al. | 473/441 |
| 4,087,089 | A | * | 5/1978 | Forrest | 473/445 |
| 5,385,523 | A | * | 1/1995 | Forrest | 473/445 |

OTHER PUBLICATIONS

Pertinent Pages from the 1999–2000 RAE CROWTHER Catalog Describing a Machine sold by Crowther under the name "The Defensive Reaction Machine".

* cited by examiner

*Primary Examiner*—Paul T. Sewell
*Assistant Examiner*—Alvin A. Hunter, Jr.
(74) *Attorney, Agent, or Firm*—H. Jay Spiegel

(57) ABSTRACT

A lineman trainer includes a base on which are mounted three receiving brackets. Pads are mounted over these brackets. Each of the brackets is mounted on a mechanism that allows the brackets to move. An actuator mechanism may be manipulated by a coach or other operator to activate the brackets independently of one another. When the actuator is reciprocated in one direction or another, it releases one or the other of the side brackets so that a spring can pivot the brackets toward the lineman. When the actuator is rotated so that its handle travels downwardly, the central bracket is released and springs push it directly outwardly toward the lineman. When a lineman hits a released bracket, it is moved back to the locked position ready for another movement when actuated by the coach or other operator.

18 Claims, 6 Drawing Sheets

TRIPLE REACTOR LINEMAN TRAINER

BACKGROUND OF THE INVENTION

The present invention relates to a triple reactor lineman trainer. In the prior art, tackling dummies and blocking sleds are well known. Blocking sleds typically used today include a base on which are mounted one or more blocking pads which are rigidly fixed to the base or fixed via a strong spring mechanism. The pads remain stationary with respect to the base until they are struck by a blocker. When struck, if spring mounted, they will slightly move away from the blocker and then move back toward the blocker when released.

Such blocking sleds are useful in teaching passive blocking techniques. However, such sleds may not be used to teach a lineman how to respond to aggression on the part of an opposing lineman.

A need has developed for such a device that may teach a defensive lineman how to react to the blocking techniques of an offensive lineman or vice versa. As a further aspect, the need has developed for such a device which includes a mechanism that may move toward the lineman before the lineman moves toward it. As a further aspect, a need has developed for such a device wherein a coach or other operator may manipulate the sled in such a way as to test the reactions of the lineman.

SUMMARY OF THE INVENTION

The present invention relates to a triple reactor lineman trainer. The present invention includes the following interrelated objects, aspects and features:

(1) In a first aspect, the inventive trainer may be mounted on a sled or, alternatively, may be mounted on a post.

(2) Whether mounted on a sled or a post, the inventive triple reactor lineman trainer includes a base on which are mounted three pad receiving brackets. Pads are mounted over these brackets and may be made of a design resembling the torso of an offensive lineman. The distance between the "armpits" of the pad may be set wider or narrower than the typical lineman. Where set narrower, the purpose is to increase the accuracy of movement of the lineman using the device. Where set wider, the intent is to provide a pad which presents a bigger target.

(3) Each of the brackets is mounted on a mechanism that allows the brackets to move. Thus, in the preferred embodiment, the middle bracket may reciprocate fore and aft. In the preferred embodiment, the side brackets to either side of the central bracket are mounted to pivot outwardly and inwardly toward the defensive lineman in a symmetrical manner.

(4) An actuator mechanism is provided on the base behind the brackets which may be manipulated by a coach or other operator to activate the brackets. The actuator includes an elongated rod that may be reciprocated side-to-side and may be rotated about an axis parallel to the lateral extent of the base.

(5) When the actuator is reciprocated in one direction or another, depending upon the direction of reciprocation, it releases one or the other of the side brackets so that a spring can pivot the brackets toward the lineman. When the actuator is rotated so that its handle travels downwardly, the central bracket is released and springs push it directly outwardly toward the lineman. Whichever bracket has been so activated, when the lineman hits it, it is moved back to the locked position ready for another movement when actuated by the coach or other operator.

As such, it is a first object of the present invention to provide a triple reactor lineman trainer.

It is a further object of the present invention to provide such a device including three pads that may be moved responsive to actuations by an operator.

It is a still further object of the present invention to provide such a device wherein the central pad reciprocates and the side pads pivot.

It is a still further object of the present invention to provide such a device which may be mounted either on a sled or a post.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
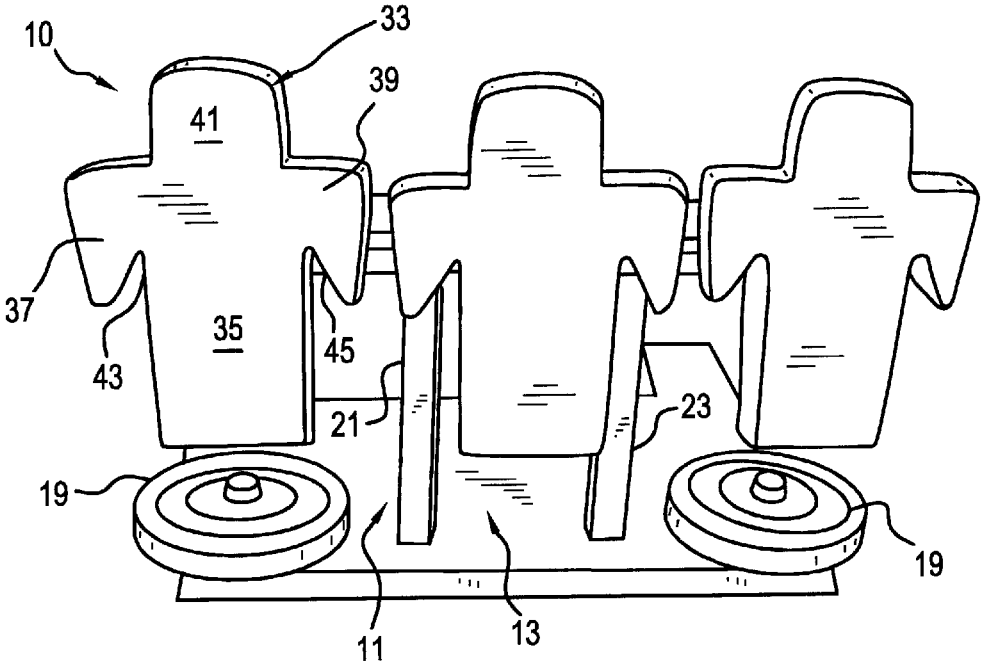
FIG. 1 shows a front perspective view of the inventive triple reactor lineman trainer, with the inventive device shown mounted on a sled.
Figure 2:
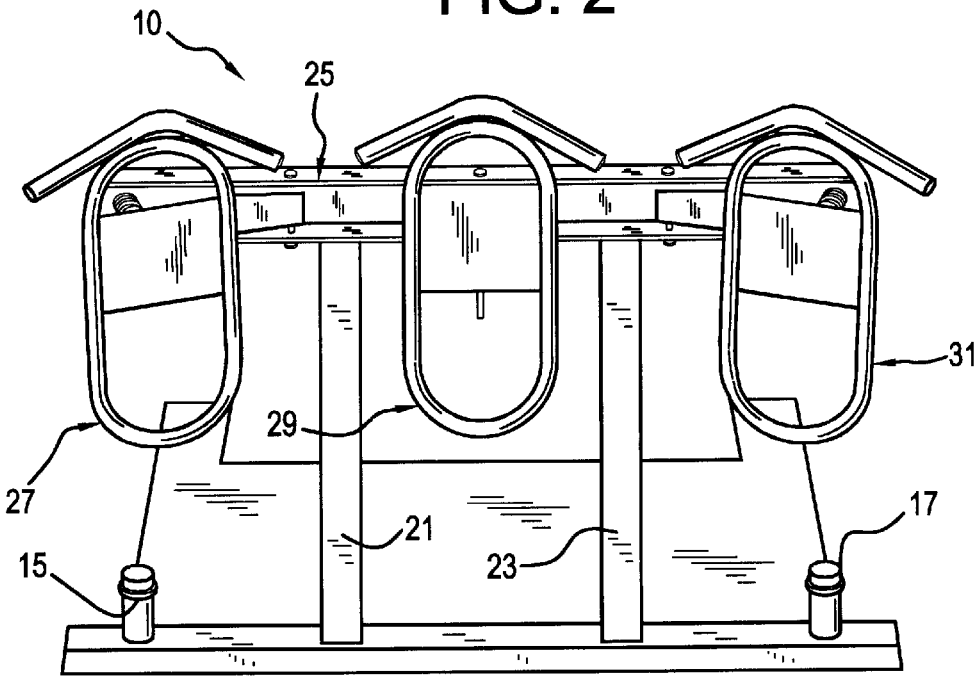
FIG. 2 shows a view similar to that of FIG. 1 but with the pads removed to show details of the brackets.

With reference, first, to FIGS. 1 and 2, a first embodiment of the present invention is generally designated by the reference numeral 10 and is seen to include a base 11 mounted on a sled 13 having a configuration well known to those skilled in the art. The base 11 has two upstanding posts 15 and 17 thereon which are provided to allow placement of barbell weights 19 to increase the resistance of the sled 13 should it be used to have linemen push it along a field or other surface.

The base 11 consists of upstanding vertical posts 21 and 23 to which are mounted an elongated horizontal beam 25 comprising mounting means (FIG. 2).

With further reference to FIGS. 1 and 2, three brackets are mounted on the beam 25 and are designated by the reference numerals 27, 29 and 31. As should be understood from a comparison of FIGS. 1 and 2, pads 33 are mounted in a suitable manner over the brackets 27, 29 and 31. Each pad 33 includes a torso section 35, wing-like portions 37 and 39 representing the arms of a player, and a head section 41. The torso section 35 may be provided with a prescribed width so that the armpits 43 and 45 are spaced apart a distance bearing some relation to the normal spacing of the armpits of an offensive lineman. If desired, this spacing may be made larger or smaller than that typical spacing for reasons such as those set forth hereinabove in the SUMMARY OF THE INVENTION.

Figure 3:
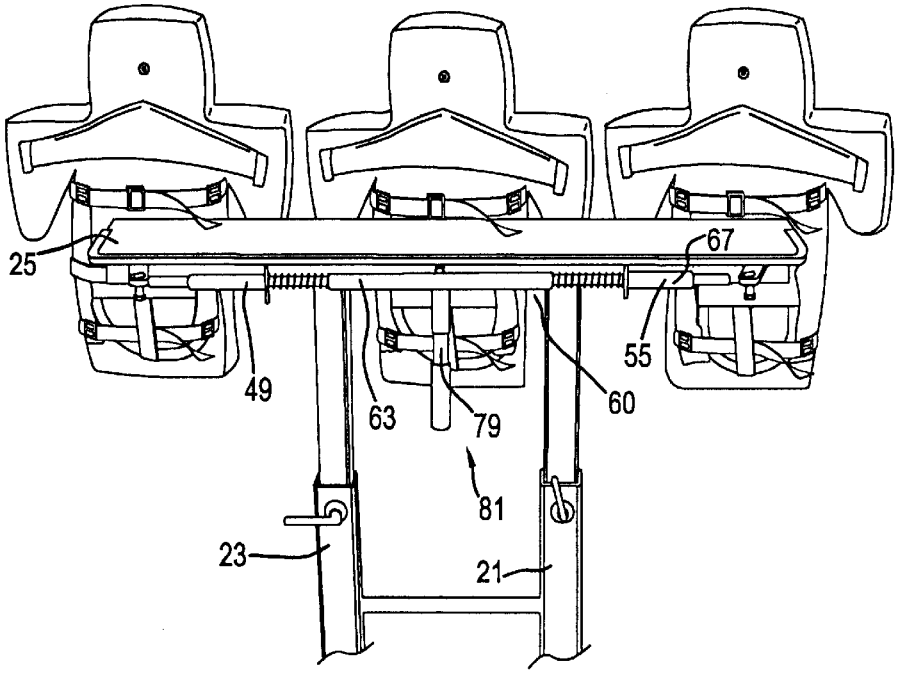
FIG. 3 shows a rear view of the inventive lineman trainer.

As best seen in FIG. 3, the posts 21 and 23 may be made of two telescoping members so that the height of the beam 25 may be adjusted as desired. Additionally, the base 11 with the upper halves of the posts attached thereto may easily be removed from the lower halves of the posts for storage or for installation on a different support.

Figure 4:
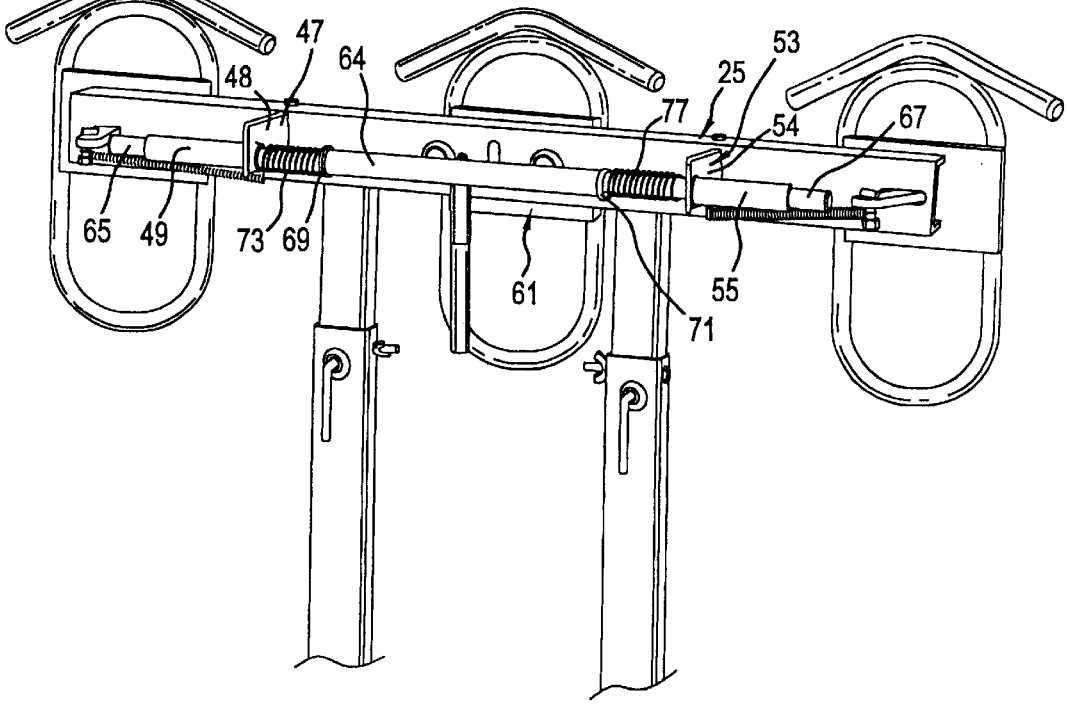
FIG. 4 shows a view similar to that of FIG. 3 but with the pads removed to show detail.

With reference to FIGS. 3 and 4, it is seen that the beam 25 includes a wall 28 having two rearwardly depending brackets 47 and 53. The bracket 47 consists of a perpendicular plate 48, to which is affixed an elongated tube 49 that runs parallel to the direction of extension of the beam 25. Similarly, the bracket 53 includes a plate 54 and a tube 55.

Figure 8:
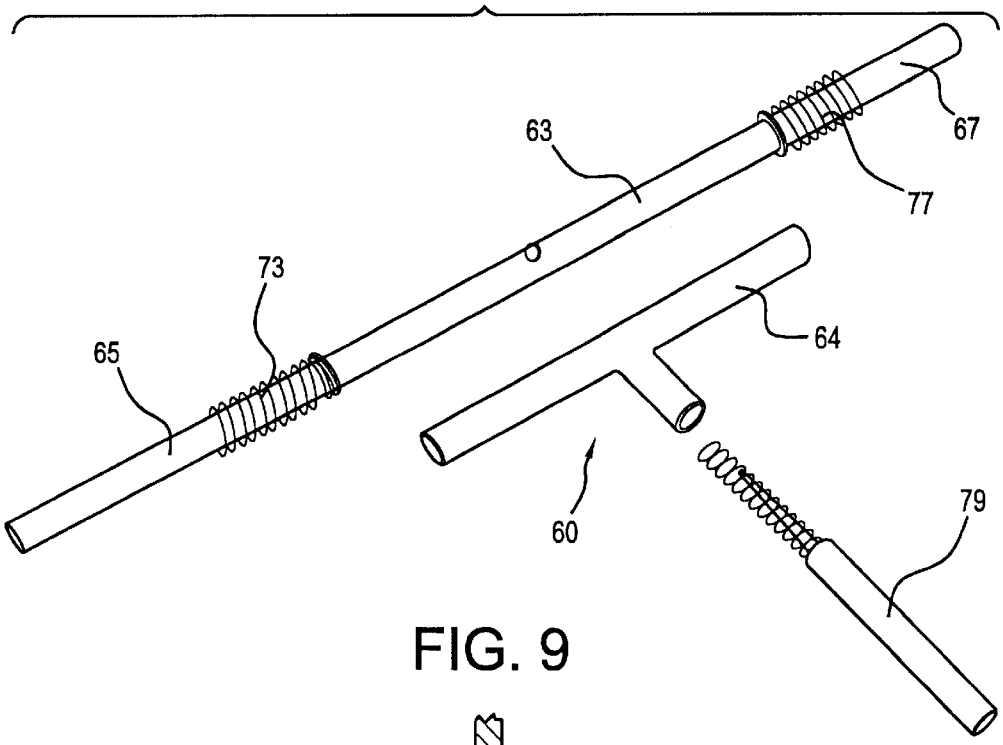
FIG. 8 shows an exploded perspective view of the handle mechanism of the present invention.

With further reference to FIGS. 3, 4 and 8, latch releasing means comprising an actuator arm is generally designated by the reference numeral 60 and includes an elongated circular cross-section tube 61 having a center section 63 (FIG. 8) in a central location and two side sections 65 and 67. As best seen in FIGS. 3 and 4, enlarged disks 69 and 71 define the transition between the central section 63 and the side sections 65 and 67.

A compression spring 73 is interposed between the disk 69 and the plate 48. Similarly, a compression spring 77 is interposed between the disk 71 and the plate 54. As should be understood by those skilled in the art, when the arm 61 is moved to the right in the view of FIG. 4, when it is then released, the spring 77 will restore it to the position shown in FIGS. 3 and 4 with the spring 73 assisting in centering the arm 61. A similar action occurs should the arm 61 be moved in the left-hand direction in the view of FIGS. 3 and 4, whereupon the spring 73 will restore the arm 61 to the position shown in FIGS. 3 and 4. As also should be understood, the arm 61 may rotate about its axis of elongation. In any of the motions described above, the user grabs a gripping rod 79 that may, if desired, have a rubberized cover 81 over its proximal end. The gripping rod or handle 79 also includes a tube 64 slidably mounted over the section 63 of the actuator arm 60 so that it may rotate with respect thereto.

Figure 5:
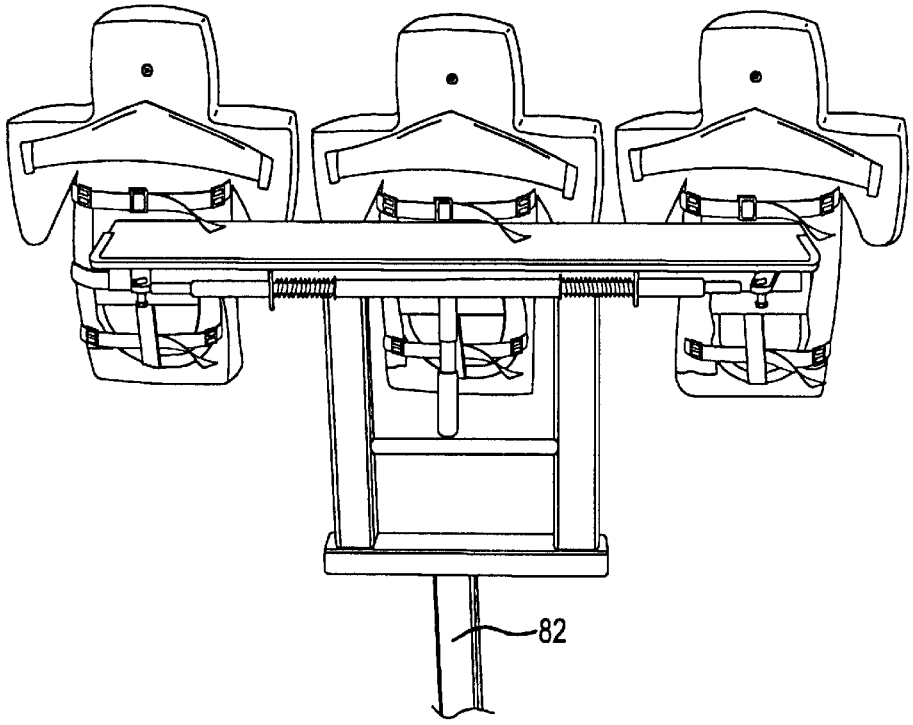
FIG. 5 shows a view similar to that of FIG. 3 but showing an alternative construction wherein the inventive device is mounted on a post.

FIG. 5 shows an alternative embodiment to the embodiment of FIGS. 1–4 wherein the upper halves of the posts 21 and 23 are mounted on a post 82 embedded in the ground in any manner well known to those skilled in the art. In all other respects, the embodiment shown in FIG. 5 is the same as the embodiment shown in FIGS. 1–4.

With reference, now, to FIGS. 6–11, an explanation of the operation of the brackets 27, 29 and 31 will now be described.

Figure 6:
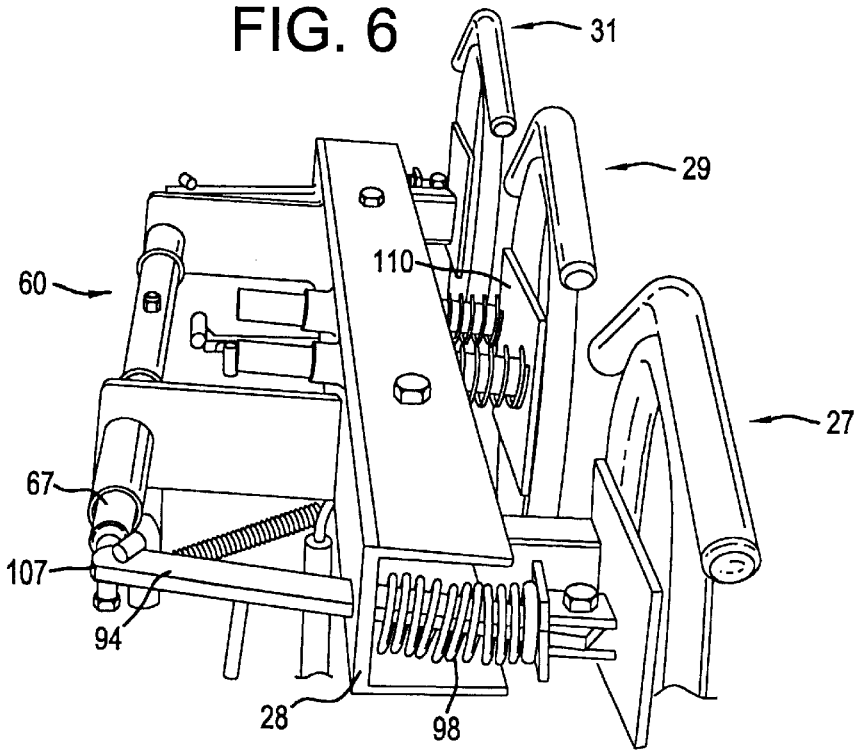
FIG. 6 shows a side perspective view giving details of some of the actuator mechanisms of the present invention.
Figure 7:
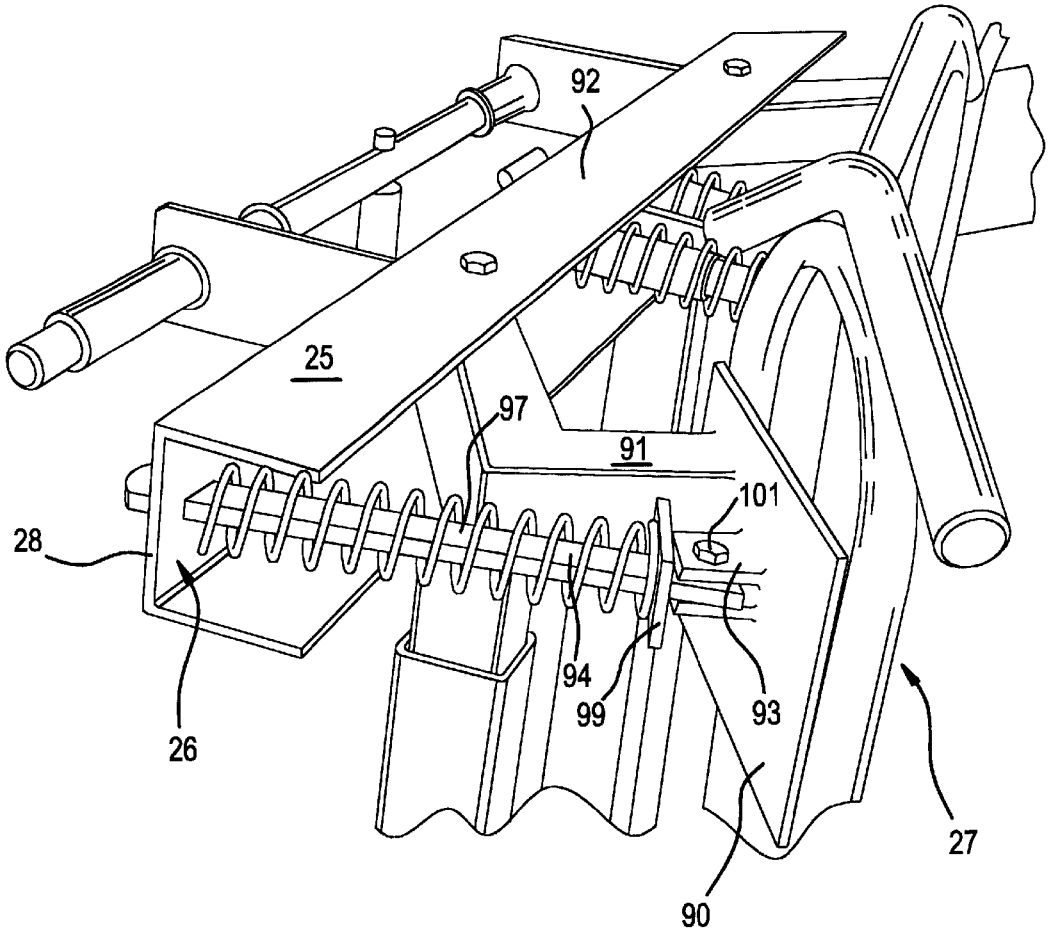
FIG. 7 shows a further side perspective view of the present invention showing the actuator mechanisms in different orientations, having been actuated.
Figure 9:
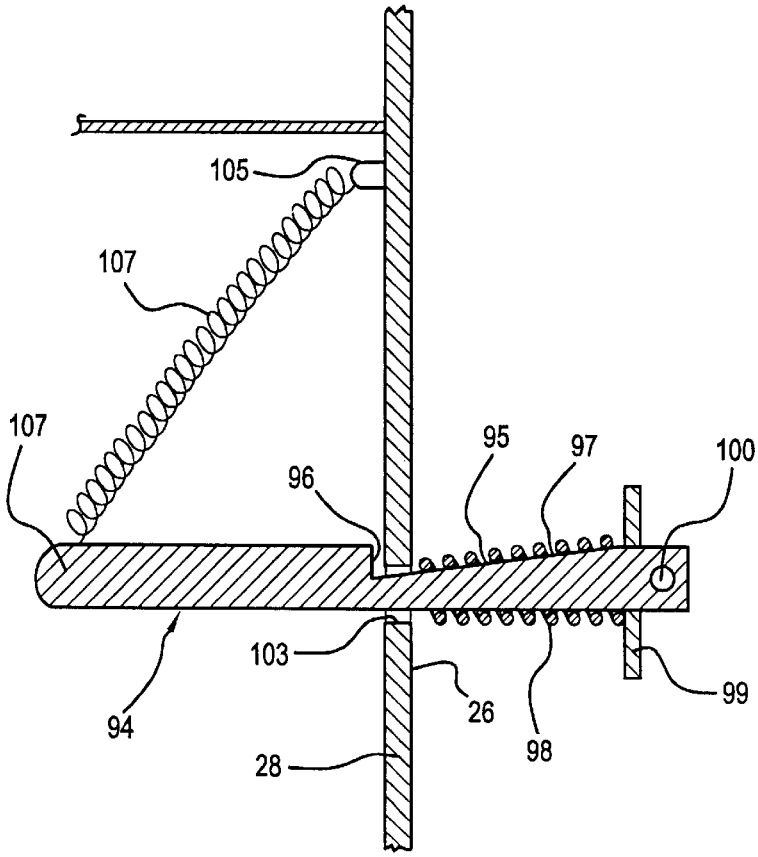
FIG. 9 shows a top cross-sectional view of the actuator mechanism for the side brackets.

With reference first to FIGS. 6, 7 and 9, the operation of actuator means for the side brackets 27 and 31 will be explained in detail. With reference first to FIGS. 6 and 7, it is seen that the bracket 27 includes a rear plate 90 to which is welded an L-shaped arm 91 which is pivotably mounted to the beam 25 by an elongated bolt 92. The plate 90 has a bracket 93 welded thereto to which is pivotably mounted an elongated leg 94.

With reference to FIG. 9, the leg 94 has latch means comprising a notch 95 therein, including a rear wall 96 and a ramp surface 97. Biasing means comprising a compression spring 98 surrounds the leg 94 and has one end bearing against a surface 26 of the beam (FIGS. 7 and 9) and its other end bearing against a plate 99 mounted on the leg 94 adjacent the location where it is mounted to the bracket 93. With reference to FIG. 9, the leg 94 has an opening 100 at its distal end which matches with openings (not shown) in the bracket 93 so that an elongated bolt 101 (FIG. 7) can be fastened through the aligned openings to pivotably mount the leg 94 to the plate 90.

With particular reference to FIGS. 6 and 9, the surface 26 of the beam 25 is on the vertically oriented wall 28 of the beam 25. This wall 28 has a slot 103 extending therethrough (FIG. 9) through which the leg 94 is slidably mounted. The wall 28 (FIG. 9) has a bracket 105 that allows attachment of a tension spring 107 between the bracket 105 and the end 107 of the leg 94, for a purpose to be described in greater detail hereinafter.

With reference to FIGS. 3 and 6, the end 67 of the actuator arm 60 is located to be engageable with the end 107 of the leg 94.

Now, looking at FIGS. 3, 6 and 9, the operation of the bracket 27 should be simple to understand. In the position shown in FIG. 6, the leg 94 is in the position shown in FIG. 9 with the shoulder 96 engaging behind the slot 103 and with the compression spring 98 compressed as far as possible. In that position, the actuator arm 60 is moved to the right in the view of FIG. 3 by grabbing the handle 79 and moving it in that direction. The end 67 of the arm 60 engages the end 107 of the leg 94 and moves it in the right-hand direction in the view of FIG. 3, thereby dislodging the shoulder 96 from the slot 103 of the wall 28 so that the compression spring 98 is free to expand. When such expansion occurs, with reference to FIG. 7, the bracket 27 pivots about the bolt 92 to the position shown in FIG. 7. When a lineman hits the pad 33 that is mounted over the bracket 27 as shown in FIG. 1, the bracket 27 is pivoted back to the position shown in FIGS. 3, 6 and 9. When this occurs, the tension spring 107 which is sized and configured to be under tension in the configuration of the bracket 27 shown in FIG. 7 pulls the end 107 of the leg 94 in the upward direction in the view of FIG. 9 so that once the shoulder 96 gets past the slot 103 in the wall 28, the end 107 of the leg 94 pivots upwardly in the view of FIG. 9 to lock the leg 94 in the position shown in FIGS. 6 and 9 until such time as the actuator arm 60 is again moved in the manner described hereinabove.

As should be also understood, the bracket 31 is symmetrical with the bracket 27 so that the same actuation takes place when the actuator arm 60 is moved in the left-hand direction of FIG. 3. Thus, as should be understood from the above discussion, when the shoulder 96 of the leg 94 is released, thereby pivoting the bracket 27, the bracket 27 pivots toward the brackets 29 and 31. Similarly, when the actuator arm 60 is moved in the left-hand direction of FIG. 3, the bracket 31 pivots in a direction toward the brackets 27 and 29 using the identical but symmetrical actuating mechanism.

Now, with reference to FIGS. 6, 10 and 11, the operation of actuator means for the bracket 29 will now be explained.

Figure 10:
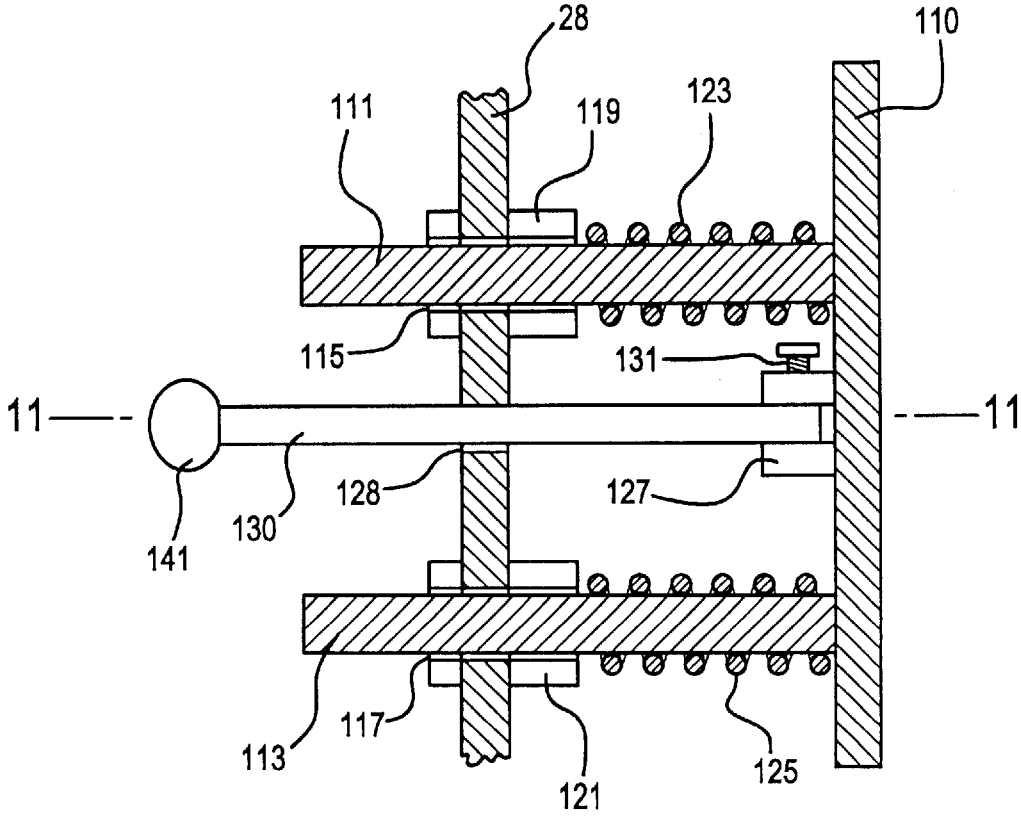
FIG. 10 shows a top cross-sectional view of the actuator mechanism for the central bracket.

With reference first to FIGS. 6 and 10, the bracket 29 has a plate 110 mounted on its rear surface. Elongated guide rods 111 and 113 are fastened to the plate 110 and extend through openings 115 and 117, respectively, in the wall 28. Guide tubes 119 and 121 help to guide the rods 111 and 113, respectively, through the wall 28 and provide structural strength as well. A compression spring 123 is interposed between the guide tube 119 and the plate 110 while a compression spring 125 is placed between the guide tube 121 and the plate 110. The springs 123 and 125 bias the plate 110 and the bracket 29 in the right-hand direction in the view of FIG. 10.

Figure 11:
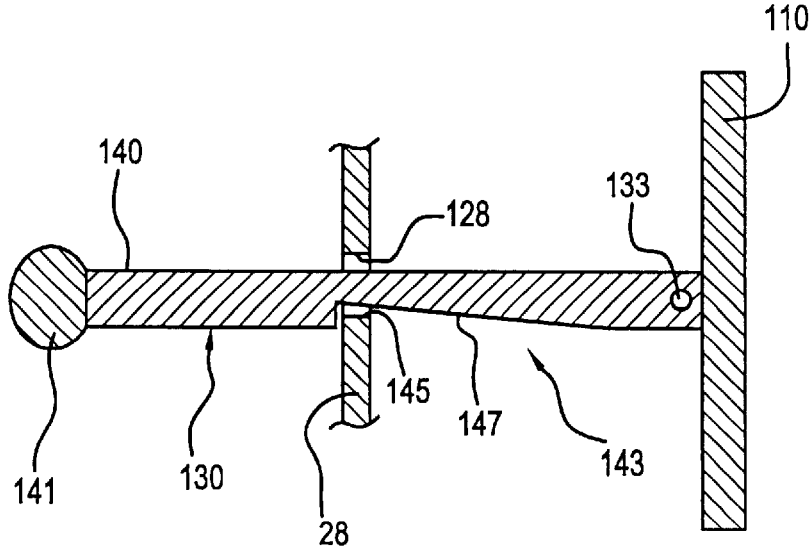
FIG. 11 shows a cross-sectional view along the line 11—11 of FIG. 10.

With further reference, now, to FIGS. 10 and 11, it is seen that a bracket 127 is mounted on the rear surface of the plate 110 and pivotably receives a leg 130 through the use of a bolt 131 extending through aligned openings (not shown) in the bracket 127 and an opening 133 (FIG. 11) in the leg 130. The proximal end 140 of the leg 130 has a cylindrical member 141 perpendicularly mounted perpendicularly thereon for a purpose to be described in greater detail hereinafter. With further reference to FIGS. 10 and 11, it is seen that the leg 130 extends through a slot 128 in the wall 28 and the leg 130 includes a notch 143 consisting of a shoulder 145 and a ramp surface 147.

With this explanation having been given, the operation of the central bracket 29 will now be described. In the orientation of parts shown in FIGS. 6, 10 and 11, the shoulder 145 is in the position shown in FIG. 11 with respect to the slot 128 and the plate 110 and the bracket 29 attached thereto are locked in the position shown in FIGS. 6, 10 and 11, with the springs 123 and 125 compressed in the manner shown.

With reference back to FIG. 3, if the handle 81 is gripped and pivoted downward and forward toward the pads 33 in the view of FIG. 3, the arm 79 will engage the cylinder 141 (FIGS. 10 and 11) and will pivot the leg 130 in the upward direction in the view of FIG. 11, thereby lifting the shoulder 145 thereof so that the leg 130 may reciprocate through the slot 128 in the wall 28. At that point, the compression springs 123 and 125 reciprocate the plate 110 and the bracket 29 in the right-hand direction in the view of FIGS. 6, 10 and 11, thereby extending the pad 33 affixed over the bracket 29.

When a lineman strikes the pad 33 affixed to the bracket 29, the bracket 29 will be moved in the left-hand direction in the view of FIGS. 6, 10 and 11 until the shoulder 145 travels past the slot 128 of the wall 28, whereupon, through force of gravity, the leg 130 will pivot in the counterclockwise direction in the view of FIG. 11 to the position shown in FIG. 11 wherein the leg 130 is locked and the pad 33 affixed to the bracket 29 is fully retracted and ready for the next actuation.

The present invention has great advantages over the prior art. As should be understood from the above description, each separate bracket with a pad affixed thereto can be activated individually. Furthermore, all of the activations are carried out through a single common actuator arm. The height of the inventive device can be adjusted in order to allow teaching for both offense and defense.

In a further aspect due to the differing mounting means described above, the inventive device can be mounted indoors or outdoors and can be changed from one mode to the other in a short period of time.

Furthermore, the specific pads that are employed in the preferred embodiment of the present invention are designed to teach the player correct hand position based upon their resemblance to the human form.

As such, an invention has been disclosed in terms of preferred embodiments thereof which fulfill each and every one of the objects of the invention as set forth hereinabove and provide a new and useful triple reactor lineman trainer of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. An improved lineman trainer, comprising:

a) a base including first mounting means for pivotably supporting a first bracket carrying a pad and second mounting means for reciprocably supporting a second bracket carrying a pad;

b) actuator means for actuating said first and second brackets independently of one another, comprising:

i) first latch means associated with said first mounting means for releasably latching said first bracket in a first position in which said first bracket is retracted and second latch means associated with said second mounting means for releasably latching said second bracket in a first position in which said second bracket is retracted;

ii) biasing means for biasing each said bracket toward a second position in which each said bracket is extended;

iii) latch releasing means for releasing each of said first and second latches independently of one another, whereby said biasing means moves one or another of said brackets from said first position to said second position, said latch releasing means comprising an elongated bar mounted on said base, said elongated bar linearly reciprocating in a direction perpendicular to a direction of reciprocation of said second bracket to release said first latch means and rotating to a position to permit release of said second latch means.

2. The trainer of claim 1, wherein said base is carried on a mounting post embedded below a ground surface.

3. The trainer of claim 1, wherein said base is carried on a sled adapted to slide over a ground surface.

4. The trainer of claim 1, wherein said first latch means includes an elongated arm pivotably mounted on said first bracket at a first end thereof, said arm having a second end movable through an opening in said first mounting means.

5. The trainer of claim 4, wherein said first latch means further includes a notch in said arm engageable with said opening to releasably latch said arm in said first position.

6. The trainer of claim 5, wherein said biasing means for said first bracket comprises a spring surrounding said arm and interposed between said first mounting means and said first bracket.

7. The trainer of claim 6, wherein said first and second mounting means comprise a common generally horizontal beam.

8. The trainer of claim 5, further including a tension spring mounted between said second end of said arm and said first mounting means, said tension spring biasing said arm in a pivoting direction adapted to latch said notch in said opening.

9. The trainer of claim 1, wherein said first and second mounting means comprise a common generally horizontal beam.

10. The trainer of claim 9, further including a third bracket pivotably movable with respect to said beam.

11. The trainer of claim 10, wherein said second bracket is located between said first and third brackets.

12. The trainer of claim 1, wherein said first bracket is pivotably movable with respect to said mounting means about a generally vertical pivot axis.

13. The trainer of claim 12, wherein said second bracket is reciprocably movable with respect to said mounting means about a generally horizontal axis of reciprocation.

14. An improved lineman trainer, comprising:

a) a base including mounting means comprising a horizontal bar for movably mounting at least first and second brackets, each carrying a pad;

b) actuator means for actuating each of said brackets, comprising:

i) latch means for each bracket associated with said mounting means for releasably latching actuator means for each bracket in a first position in which each said bracket is retracted;

ii) biasing means for biasing each said bracket toward a second position in which said bracket is extended;

iii) latch releasing means for releasing one of said latch means independently of another of said latch means, whereby said biasing means moves a said bracket from said first position to said second position;

c) said latch means including an elongated arm pivotably mounted on each bracket at a first end thereof, each said arm having a second end movable through a separate opening in said bar;

d) said latch means further including a notch in each said arm engageable with a respective said opening to releasably latch said arm in said first position;

e) said biasing means comprising a spring surrounding each said arm and interposed between said bar and a respective said bracket;

f) said latch releasing means being mounted on said bar and comprising an elongated movable bar engageable with said second ends of said arms to release said notches from engaging said respective openings;

g) said latch releasing means reciprocating to release said first bracket while allowing said second bracket to remain latched and rotating to release said second bracket while allowing said first bracket to remain latched;

h) said first bracket being pivotably movable with respect to said bar and said second bracket being reciprocably movable with respect to said bar, said reciprocating movement of said bar being perpendicular to said reciprocating movement of said second bracket.

15. The trainer of claim 14, further including a tension spring mounted between said second end of said arm of said first bracket and said bar, said tension spring biasing said arm in a pivoting direction adapted to latch said notch in said opening.

16. The trainer of claim 14, wherein said first bracket is pivotably movable about a generally vertical axis.

17. The trainer of claim 14, wherein said second bracket is reciprocable along a generally horizontal axis of reciprocation.

18. An improved lineman trainer, comprising:

a) a base including first mounting means for pivotably supporting a first bracket carrying a pad and second mounting means for reciprocably supporting a second bracket carrying a pad;

b) actuator means for actuating said first and second brackets independently of one another, comprising:

i) first latch means associated with said first mounting means for releasably latching said first bracket in a first position in which said first bracket is retracted and second latch means associated with said second mounting means for releasably latching said second bracket in a first position in which said second bracket is retracted;

ii) biasing means for biasing each said bracket toward a second position in which each said bracket.is extended;

iii) latch releasing means for releasing each of said first and second latches independently of one another, whereby said biasing means moves one or another of said brackets from said first position to said second position, said latch releasing means comprising an elongated bar having an axis of elongation perpendicular to a direction of reciprocation of said second bracket and mounted on said base, said elongated bar linearly reciprocating along said axis of elongation to release said first latch means and moving in a direction other than along said elongated axis to release said second latch means.

* * * * *